United States Patent [19]

Murakami et al.

[11] 4,130,446

[45] Dec. 19, 1978

[54] PROCESS FOR PHOSPHATE CONVERSION COATING WITH TREATMENT OF RINSE WATER BY REVERSE OSMOSIS AND ION EXCHANGE

[75] Inventors: Ryoichi Murakami, Kyoto; Masahiro Zinnouti, Kobe, both of Japan

[73] Assignee: Nippon Paint Co., Ltd., Osaka, Japan

[21] Appl. No.: 788,964

[22] Filed: Apr. 19, 1977

[30] Foreign Application Priority Data

Apr. 19, 1976 [JP] Japan ..... 51-45120

[51] Int. Cl.[2] ..... C23F 7/10

[52] U.S. Cl. ..... 148/6.15 Z; 148/6.15 R; 427/345

[58] Field of Search ..... 204/DIG. 13; 148/6.15 R, 6.15 Z; 427/345

[56] References Cited

U.S. PATENT DOCUMENTS 3,996,072 12/1976 Oka et al. ..... 148/6.15 Z

FOREIGN PATENT DOCUMENTS 50-151760 12/1975 Japan ..... 204/DIG. 13

OTHER PUBLICATIONS

Donelly et al., Plating, May 1974, pp. 432–442.

Merser et al., Chem. Abs. 80:872196, 1974.

*Primary Examiner*—Ralph S. Kendall

*Attorney, Agent, or Firm*—Wenderoth, Lind & Ponack

[57] ABSTRACT

A process for phosphate conversion coating iron and steel which includes a multi-step water rinsing stage after the conversion coating stage, which comprises subjecting a part of the rinsing water used therein to a reverse osmosis treatment, returning the concentrated liquid thereof to the conversion coating stage, and using the filtrate as replenishing water for the conversion coating and/or the degreasing and water rinsing stages after subjecting it to an ion exchange treatment.

4 Claims, 2 Drawing Figures

Figure 1:
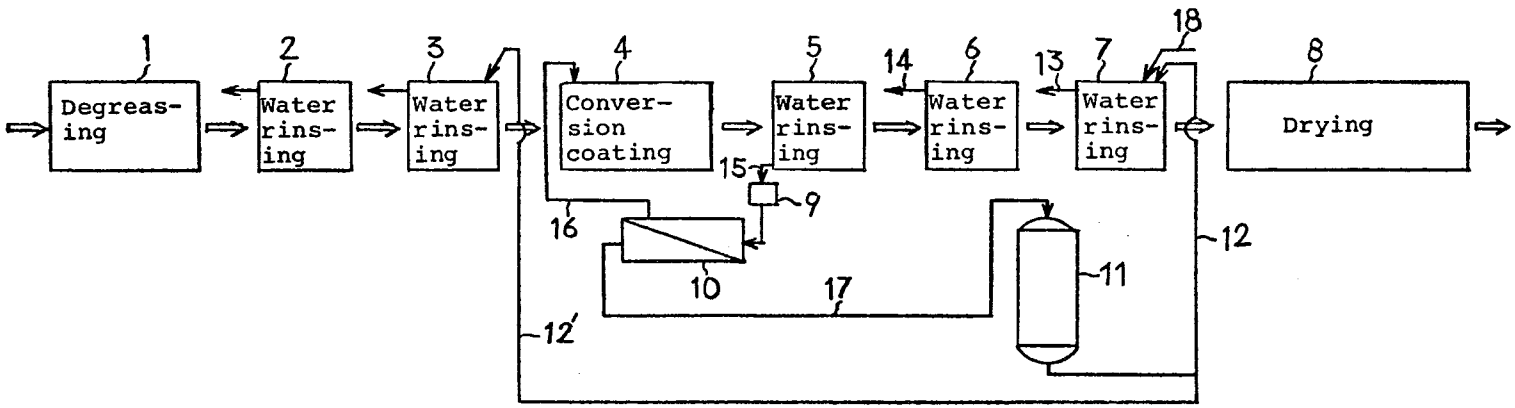

PROCESS FOR PHOSPHATE CONVERSION COATING WITH TREATMENT OF RINSE WATER BY REVERSE OSMOSIS AND ION EXCHANGE

The present invention relates to a process for phosphate conversion coating iron and steel, more particularly to a process which makes it possible to re-utilize a part of the rinsing water of the water rinsing stage in the closed type phosphate conversion treatment for iron and steel which includes the phosphate conversion stage and the water rinsing stage, by concentrating and recovering the components useful for conversion coating therefrom, and to re-utilize the rest of said rinsing water as the replenishing water for the water rinsing stage.

The conventional phosphate conversion process for iron and steel comprises the stages of degreasing — first water rinsing — second water rinsing — conversion coating — third water rinsing — fourth water rinsing — fifth water rinsing — drying, wherein fresh water is replenished at all times to prevent contamination of rinsing water, because the liquid used for degreasing or conversion coating which adheres to the treated object is taken into each water rinsing bath and sufficient rinsing is not achieved. In the conversion coating bath, the chemicals are replenished in proportion to the consumption of the treating liquid component by conversion coating, sludge formation, carrying-off of the treating liquid, etc. and the bath is controlled so that the treating liquid maintains constant values of total acidity, acid ratio, concentrations of zinc ions, etc. Also, as an agent for accelerating the conversion coating reaction, one or more alkali metal salt or ammonium salt of nitrous acid, chloric acid, or bromic acid is usually used and control is made to maintain the ion concentration thereof constant.

On the other hand, from the viewpoint of the recent trend for prevention of environmental pollution and saving of resources, various closed type systems free from constant drainage are being developed in the field of the surface treatment of these metals. These developments are observed, for example, in the spray device for surface treatment of metal disclosed in U.S. Pat. No. 3,906,895, method for treating the metal ion containing liquid disclosed in Japanese patent publication (unexamined) No. 151,760/1975, etc. When the above control processes are applied to the above closed type systems, alkali metal ions or ammonium ions which are unnecessary for the conversion coating, taken in from the conversion coating reaction accelerator, are continuously added to the conversion coating bath, wherein the nitrite ions in the treating liquid are either oxidized or reduced to nitrate ions, chlorate ions to chloride ions, bromate ions to bromide ions, and the concentrations of the nitrate ion, chloride ion, bromide ion, etc. are unfavorably accumulated and increased, thereby resulting in a loss of balance of the ion concentrations in the treating liquid to cause undesirable defects to the conversion coated film such as yellow rust, coarse coating, etc. When an ordinary phosphate conversion coating treatment is applied by the osmotic membrane treating method disclosed in Japanese patent publication (unexamined) No. 151,760/1975, the problems of pollution and resource saving, etc. may be solved, but, due to the accumulation of miscellaneous ions (alkali metal ion, ammonium ion, nitrate ion, chloride ion, bromide ion, etc.) in the water rinsing bath and/or the conversion coating bath, no satisfactory coating film is obtainable because of defective conversion coating and adhesion of contaminated materials which cause yellow rust, coarse coating, etc. Also, as described in U.S. Pat. No. 3,996,072 there is a method which provides a partial solution to the above problem, i.e. a method of replenishing nitrite ions utilizing anion exchange resin. However, according to this method, it is difficult not only to jointly use chlorate ion or bromate ion with nitrite ion as an accelerator but also to replenish a large amount of nitrite ion in a short time, and control is difficult.

Accordingly, in order to settle various points shown in the above, the following conditions must be considered.

(1) Not to discharge out of the system the substance which is liable to invite environmental pollution caused by conversion coating;

(2) The chemicals for conversion coating can be economized from the viewpoint of resource saving;

(3) The treating liquid can stably be maintained without unfavorable accumulation of alkali metal ions, ammonium ion, nitrate ion, chloride ion, bromide ion, etc. in the conversion coating bath.

The object of the present invention is to provide a process for phosphate conversion coating for iron and steel and a process for controlling the treating liquid which satisfy the above three conditions.

As a result of the extensive study for attaining the above object, the present inventors have found that, when the rinsing water containing phosphate treating liquid is treated with a reverse osmosis membrane, the relatively large molecules (e.g. phosphoric acid and its zinc, calcium, manganese, and nickel compounds and alkali metal compounds, zinc, nickel, and manganese compounds of nitric acid, chlorate) show a removal rate of more than 99%, but the comparatively small molecules (e.g. nitric acid, hydrochloric acid, hydrobromic acid and their alkali metal salts and ammonium salts) are unsatisfactorily removed and are carried into the filtered water in reflection of the property of the reverse osmosis membrane. Thus, the present inventors have confirmed that, as it is possible to remove, by utilization of the above characteristics, the alkali metal ion, ammonium ion, nitrate ion, chloride ion, bromide ion, etc. which may provide undesirable effect to the conversion coating if unnecessarily accumulated in the phosphate treatment, the accumulation of such ions in the phosphate treating solution can be prevented.

According to the present invention, there is provided a process for phosphating iron and steel which includes a phosphate conversion coating stage and a multi-step water rinsing stage, which comprises subjecting a part of the rinsing water used therein to a reverse osmosis treatment, returning the concentrated liquid thereof to the conversion coating stage, and using the filtrate as replenishing water for the conversion coating and/or the degreasing and water rinsing stages after subjecting it to ion exchange treatment.

The phosphate treating liquids applicable to the present invention are the conventionally adopted zinc phosphate treating liquid, calcium-modified zinc phosphate treating liquid, and manganese-modified zinc phosphate treating liquid, for iron and steel. As an example, there may be shown an aqueous solution of pH 3 having the following composition:

| | |
|---|---|
| Zinc ion | 0.08 % by weight |
| Nickel ion | 0.02 % by weight |
| Sodium ion | 0.3 % by weight |
| Phosphate ion | 1.0 % by weight |
| Nitrate ion | 0.5 % by weight |
| Nitrite ion | 0.008 % by weight |

The rinsing water to be subjected to reverse osmosis treatment usually contains the above treating liquid at 1/5 to 1/20 concentration.

As for the apparatus to be used for the reverse osmosis treatment, those ordinarily available on market may be utilized, which are, for example, flat membrane type, tubular type, spiral type, and hollow fiber type. For the reverse osmosis membrane thereof, there may be utilized various cellulose acetate membranes and aromatic polyamide membranes having pores of 1–10 Å in diameter. If the membrane having the pore diameter larger than 10 Å is used, the penetrating water contains the components useful for the conversion coating in addition to the miscellaneous ions, with the result that not only a large frequency of regeneration of ion exchange resin is necessitated but also a loss of material resources is invited. In order to prevent blockade of such reverse osmosis membrane device, filters are generally used. Though differing based on the contamination of rinsing water, such filters may usually be sponge filters or plastic filters having a pore size of 5–75$\mu$.

As for the resins to be used for the ion exchange treatment, ordinary H-type and OH-type resins may be used as a mixed bed, or they may be independently used.

Figure 2:
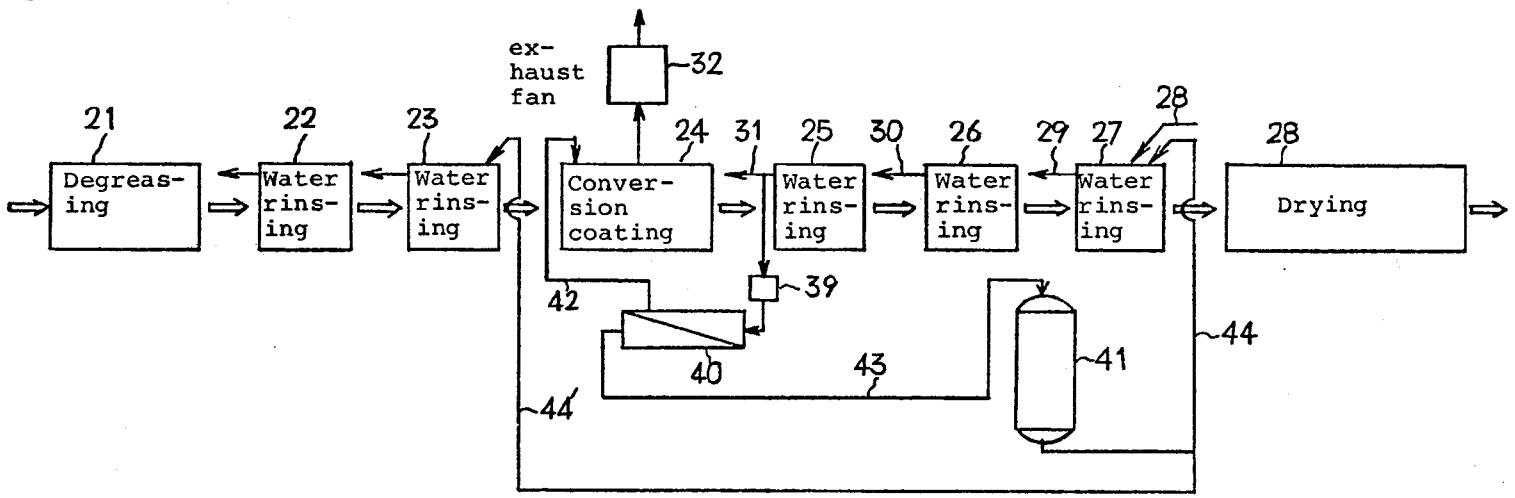

Referring to the drawings, FIG. 1 and FIG. 2 are respectively the flow sheets for practising the process of the present invention.

The system schematically shown in FIG. 1 is a phosphate conversion coating treatment system which includes the stages consisting of degreasing 1, water rinsing 2 and 3, conversion coating 4, water rinsing 5, 6, and 7, and drying 8, and is provided with filter 9, reverse osmosis membrane device 10, and ion exchange resin column 11, wherein the membrane-filtered water 12 treated through the ion exchange resin column 11 and fresh water 18 are replenished to the water rinsing section 7, and the overflow portion 13 of water rinsing section 7 is supplied to the water rinsing section 6, the overflow portion 14 of the water rinsing section 6 is supplied to the water rinsing section 5, and the overflow portion 15 of the water rinsing section 5 is supplied to the reverse osmosis membrane device 10 through the filter 9, respectively. The concentrated liquid 16 concentrated in the reverse osmosis membrane device 10 is supplied to the conversion coating section 4, and the membrane-filtered water 17 is freed from the miscellaneous ions in the H-type and OH-type mixed bed ion exchange resin column 11 to become the replenishing water 12, 12'.

The installation shown in FIG. 2 is a treating system of the present invention in which a spray device for treating the metal surface disclosed in U.S. Pat. No. 3,906,895 is adopted. The said known equipment has the stages consisting of degreasing 21, water rinsing 22 and 23, conversion coating 24, water rinsing 25, 26, and 27, and drying 28, wherein fresh water 28 is replenished to the water rinsing 27, and the overflow portion 29 of the water rinsing 27 is supplied to the water rinsing 26, the overflow portion 30 of the water rinsing 26 is supplied to the water rinsing 25, the overflow portion 31 of the water rinsing 25 is supplied to the conversion coating 24, respectively, and the portion of the increased volume in the conversion coating 24 is discharged as vapor into the atmosphere by means of the exhaust fan 32 to keep the balance of the liquid volume. In the process of the present invention, in the treatment system of the above device provided additionally with a filter 39, a reverse osmosis membrane device 40 and an ion exchange resin column 41, a part or the whole of the overflow portion 31 of water rinsing 25 is supplied to the reverse osmosis membrane device 40 through the filter 39. The concentrated liquid 42 concentrated in the reverse osmosis membrane device 40 is supplied to the conversion coating 24, and the membrane-filtered water 43 is freed from miscellaneous ions in the H-type and OH-type mixed bed ion exchange column 41 to become the replenishing water 44, 44'.

In both processes as shown in FIGS. 1 and 2, the unfavorable accumulation of miscellaneous ions in the phosphate conversion coating bath can be minimized. From the economical viewpoint, however, the process of FIG. 2 is better than the process of FIG. 1, because, if desired, the volume of the liquid treated in the reverse osmosis membrane device in FIG. 2 can be made smaller and hence the capacity of the device can be made smaller than that of FIG. 1, when the accumulation of the miscellaneous ions can be permitted to a certain extent.

As described above, the present invention provides various advantages such that, unlike the conventional processes, waste water treatment is scarcely required; the rinsing water is subjected to reverse osmosis treatment and the component useful for conversion coating contained in the rinsing water is concentrated and recovered for re-use; the membrane-filtered water containing the component unnecessary for the conversion coating is subjected to ion exchange treatment with miscellaneous ions removed therefrom and is re-utilized as replenishing water for the final rinsing water for the degreasing and/or the conversion coating; and further, on removal of the miscellaneous ions unnecessary for conversion coating, the phosphate treating liquid can stably be maintained. In other words, the process of the present invention can afford a product having an excellent phosphate conversion coating film and promises a high quality of the painted coating film, and the high quality of the product can be maintained for a long period of time.

Practical and presently preferred embodiments of the present invention are illustratively shown in the following Examples, wherein % is by weight.

EXAMPLE 1

The treating system illustrated in FIG. 1 is adopted, in which the zinc phosphate treating liquid is used for the conversion coating 4. The rinsing water 15 from the water rinsing 5 (0.6 l/min) is passed through the filter 9 (sponge filter R-2410 made by Kanegafuchi Spinning Co., Ltd.), and then introduced into the reverse osmosis membrane device 10 under the pressure of 50 kg/cm$^2$ to obtain the membrane-filtered water 17 (0.53 l/min). This membrane filtered water 17 is passed through the ion exchange resin column 11 to remove miscellaneous ions and used as the replenishing water 12 for the water rinsing 7. On the other hand, the concentrated water 16 (0.967 l/min) concentrated through the reverse osmosis membrane device 10 is returned to the conversion coating 4 for reutilization. The reverse osmosis membrane device and the membrane to be used are the BRO type reverse osmosis membrane device made by Paterson Candy Int. and the reverse osmosis membrane T-2-15 made by the same company, and the ion exchange resins are, as H-type, DIAION SK 1B (made by Mitsubishi Kasei Kogyo Co., Ltd.) treated with 1N HCl into H-type, and as OH-type, DIAION SA 10B (made by Mitsubishi Kasei Kogyo Co., Ltd.) treated with 1N NaOH into OH-type.

The liquid compositions (ppm) of the above rinsing water 15, concentrated water 16, membrane filtered water 17, and replenishing water 12 are shown in Table 1.

Table 1

| | Rinsing water | Concentrated water | Membrane filtered water | Replenishing water |
|---|---|---|---|---|
| $Zn^{2+}$ | 100 | 895 | 0.6 | Not detected |
| $Ni^{2+}$ | 35 | 315 | Not exceeding 0.1 | Not detected |
| $Na^{+}$ | 400 | 1600 | 245 | Not exceeding 0.1 |
| $PO_4^{3-}$ | 1100 | 9700 | 25 | Not detected |
| $NO_3^{-}$ | 420 | 2120 | 206 | Not detected |
| $NO_2^{-}$ | Not detected | Not detected | Not detected | Not detected |

EXAMPLE 2

The treating system shown in FIG. 1 and the known treating system illustrated in reference to FIG. 2 are adopted, in which a dull steel plate is continuously subjected to conversion coating treatment, and the compositions (% by weight) of the treating liquid and the appearances of the conversion coated films after lapse of 100 hours and 300 hours are examined.

As the degreasing solution there is used a 2% solution of RIDOLINE No. 75 (made by Nippon Paint Co., Ltd.), at the degreasing treatment temperature of 60° C. and the treating time of 1 min.

The zinc phosphate treating liquid used is that originally having the constitution of 0.100% of zinc ion, 0.035% of nickel ion, 0.30% of sodium ion, 1.1% of phosphate ion, 0.42% of nitrate ion and 0.008% of nitrite ion, with total acidity 16, acid ratio 20, and pH 3.0. The conversion coating treating temperature is 50°–55° C. and the treating time is 1 minute and 30 seconds. For replenishment of the zinc phosphate treating liquid an aqueous solution containing as the main components 2.4 mol/l of zinc ion, 5.8 mol/l of phosphate ion, and 0.25 mol/l of nickel ion is used, and the replenishment is effected at the rate of 0.188 l/hour. As the conversion coating reaction accelerator, an aqueous solution of 40% sodium nitrite is used, which is continuously added dropwise so as to make the concentration of nitrite ion in the treating liquid 0.008%.

According to the present invention process, the conversion coating is continuously practised while a part of the rinsing water is being taken out and treated, in the same manner as in Example 1. On the other hand, according to the conventional process, the conversion coating is continuously made without taking out or treatment of such rinsing water while the treating liquid is controlled by the closed type system. In both the present invention process and the conventional process, zinc phosphate conversion coating is made at the rate of the treating area of 30 $m^2$/hour, and the compositions of the treating liquid and the appearances of the conversion coated films after lapse of 100 hours and 300 hours are examined, the results of which are shown in Table 2.

Table 2

| | | Initial concentration | Conventional process After 100 hours | Conventional process After 300 hours | Present process After 100 hours | Present process After 300 hours |
|---|---|---|---|---|---|---|
| Composition of treating liquid | $Zn^{2+}$ | 0.100 | 0.079 | 0.038 | 0.098 | 0.099 |
| | $Ni^{2+}$ | 0.035 | 0.035 | 0.034 | 0.035 | 0.035 |
| | $Na^{+}$ | 0.30 | 0.45 | 0.70 | 0.32 | 0.32 |
| | $PO_4^{3-}$ | 1.1 | 1.1 | 1.0 | 1.1 | 1.1 |
| | $NO_3^{-}$ | 0.42 | 0.76 | 1.40 | 0.43 | 0.44 |
| | $NO_2^{-}$ | 0.008 | 0.008 | 0.008 | 0.008 | 0.008 |
| Appearance of conversion coated film | | Uniform, fine, excellent | Uniform, fine, excellent | Yellow rust, coarse coating, not uniform, bad | Uniform, fine excellent | Uniform, fine, excellent |

As apparent from Table 2, according to the conventional process, the nitrate ion and the sodium ion are accumulated at high concentrations in the treating liquid and the zinc ion concentration is decreased to invite unsatisfactory conversion coating. Against this, according to the process of the present invention, excellent conversion coating treatment can be made with scarce variation in the ion concentrations of nitrate ion and sodium ion and without the lowering of the concentration of zinc ion even after lapse of 300 hours.

EXAMPLE 3

In the same manner as in Example 2, manganese-modified zinc phosphate treatments for dull steel plate are carried out under the present invention process and the conventional process, respectively.

In this case, the degreasing solution used and the treatment thereby are the same as those of Example 2. The manganese-modified zinc phosphate treating liquid used is that originally having the constitution of 0.120% of zinc ion, 0.06% of manganese ion, 0.260% of sodium ion, 1.0% of phosphate ion, 0.30% of nitrate ion, 0.15% of chlorate ion, and 0.008% of nitrite ion, with total acidity 14, acid ratio 20 and pH 3.0. The conversion coating treating temperature is 50°–55° C. and the treating time is 1 minute and 30 seconds. For replenishment of the manganese-modified zinc phosphate treating liquid, an aqueous solution containing as the main components 2.4 mol/l of zinc ion, 0.25 mol/l of manganese ion, and 5.8 mol/l of phosphate ion is used, and the replenishment is effected at the rate of 0.188 l/hour. As the conversion coating reaction accelerator, a mixed aqueous solution of 35% sodium nitrite and 10% sodium chlorate is used, which is continuously added dropwise so as to make the concentration of nitrite ion in the treating liquid 0.008%.

In both the present invention process and the conventional process, conversion coatings are continuously made at the rate of the treating area of 30 $m^2$/hour in the same manner as in Example 2, and the compositions (% by weight) of the treating liquid and the appearances of the conversion coated films after lapse of 100 hours and 300 hours are examined, the results of which are shown in Table 3.

Table 3

| | | Initial concentration | Conventional process After 100 hours | Conventional process After 300 hours | Present process After 100 hours | Present process After 300 hours |
|---|---|---|---|---|---|---|
| Composition of treating liquid | $Zn^{2+}$ | 0.120 | 0.094 | 0.050 | 0.110 | 0.110 |
| | $Mn^{4+}$ | 0.060 | 0.055 | 0.054 | 0.060 | 0.057 |
| | $Na^{+}$ | 0.260 | 0.443 | 0.856 | 0.301 | 0.345 |
| | $PO_4^{3-}$ | 1.0 | 1.0 | 0.95 | 1.0 | 1.0 |
| | $NO_3^{-}$ | 0.30 | 0.55 | 1.29 | 0.35 | 0.40 |
| | $ClO_3^{-}$ | 0.15 | 0.16 | 0.14 | 0.15 | 0.16 |
| | $Cl^{-}$ | 0.00 | 0.110 | 0.305 | 0.03 | 0.07 |
| | $NO_2^{-}$ | 0.008 | 0.008 | 0.008 | 0.008 | 0.008 |
| Appearance of conversion coated film | | Uniform, fine, excellent | Uniform, fine, excellent | Yellow rust, coarse coating, not uniform, bad | Uniform, fine excellent | Uniform, fine, excellent |

As apparent from Table 3, according to the conventional process, sodium ion, nitrate ion and chloride ion are accumulated at high concentrations in the treating liquid, and unsatisfactory conversion coating is caused by decreases in zinc ion concentration and overetching. Against this, according to the process of the present invention, excellent conversion coating treatment can be made with scarce variation of their ion concentrations even after lapse of 300 hours.

EXMAPLE 4

In the same manner as in Example 2, calcium-modified zinc phosphate treatments for dull steel plate are carried out under the present invention process and the conventional process, respectively.

In this case, the degreasing solution and the treatment thereby are the same as those of Example 2. The calcium-modified zinc phosphate treating liquid used is that originally having the constitution of 0.10% of zinc ion, 0.20% of calcium ion, 0.145% of sodium ion, 0.013% of magnesium ion, 0.61% of phosphate ion, 0.85% of nitrate ion, and 0.008% of nitrite ion, with total acidity 14, acid ratio 14 and pH 2.9. The conversion coating treating temperature is 55°-60° C. and the treating time is 1 minute and 30 seconds. For replenishment of the calcium-modified zinc phosphate treating liquid, an aqueous solution containing as the main components 2.4 mol/l of zinc ion, 0.8 mol/l of calcium ion, 0.1 mol/l of magnesium ion, 5.8 mol/l of phosphate ion, and 1.8 mol/l of nitrate ion is used, and the replenishment is effected at the rate of 0.188 l/hour. As the conversion coating reaction accelerator, an aqueous solution of 40% sodium nitrite is used, which is continuously added dropwise so as to make the concentration of nitrite ion in the treating liquid 0.008%.

In both the present invention process and the conventional process, conversion coatings are continuously made at the rate of the treating area of 30 $m^2$/hour in the same manner as in Example 2, and the compositions (% by weight) of the treating liquid and the appearances of the conversion coated films after lapse of 100 hours and 300 hours are examined, the results of which are shown in Table 4.

Table 4

| | | Initial concentration | Conventional process After 100 hours | Conventional process After 300 hours | Present process After 100 hours | Present process After 300 hours |
|---|---|---|---|---|---|---|
| Composition of treating liquid | $Zn^{2+}$ | 0.10 | 0.081 | 0.045 | 0.098 | 0.098 |
| | $Ca^{2+}$ | 0.20 | 0.17 | 0.12 | 0.19 | 0.18 |
| | $Mg^{2+}$ | 0.013 | 0.013 | 0.012 | 0.012 | 0.012 |
| | $Na^{+}$ | 0.145 | 0.325 | 0.535 | 0.175 | 0.203 |
| | $PO_4^{3-}$ | 0.61 | 0.60 | 0.60 | 0.61 | 0.60 |
| | $NO_3^{-}$ | 0.85 | 1.25 | 1.95 | 0.93 | 0.98 |
| | $NO_2^{-}$ | 0.008 | 0.008 | 0.008 | 0.008 | 0.008 |
| Appearance of conversion coated film | | Uniform, fine, excellent | Partly coarse coating, somewhat bad | Yellow rust, coarse coating, not uniform, bad | Uniform, fine excellent | Uniform, fine, excellent |

As apparent from Table 4, according to the conventional process, the sodium ion and nitrate ion are accumulated at high concentrations in the treating liquid, and the concentrations of zinc ion and calcium ion are decreased to invite unsatisfactory conversion coating. Against this, according to the process of the present invention, excellent conversion coating treatment can be made with scarce variation of the concentrations of sodium ion and nitrate ion and without lowering of the concentrations of zinc ion and calcium ion even after lapse of 300 hours.

What is claimed is:

1. In a process for phosphating a substrate of iron or steel which comprises treating the substrate with a phosphating solution containing phosphate ions, zinc ions and, as an accelerator, at least one member selected from the group consisting of nitrite ions, chlorate ions and bromate ions, and rinsing the thus treated substrate with water in multiple steps, the improvement wherein a part of the rinsing water containing the phosphating solution rinsed from the surface of the substrate is passed through a reverse osmosis membrane having a pore size of 1 to 10 Å to form a concentrate and a filtrate, the concentrate is recycled for use in the phosphating solution, and the filtrate is treated with ion-exchange resins of the H-type and the OH-type to remove undesirable ions therefrom and the thus treated filtrate is then recycled for use in the rinsing water.

2. The process according to claim 1, wherein the phosphating solution further contains calcium ions or manganese ions.

3. The process according to claim 1, wherein the rinsing water to be treated in accordance with said improvement comes from a bath of the rinsing water positioned after the treatment with the phosphating solution.

4. The process according to claim 1, wherein the treated filtrate is recycled to a bath of the rinsing water positioned after the treatment with the phosphating solution.

* * * * *